US005682952A

United States Patent [19]

Stokley

[11] Patent Number: 5,682,952

[45] Date of Patent: Nov. 4, 1997

[54] EXTENDABLE CASING CIRCULATOR AND METHOD

[75] Inventor: Charles O. Stokley, Houston, Tex.

[73] Assignee: TAM International, Houston, Tex.

[21] Appl. No.: 622,208

[22] Filed: Mar. 27, 1996

[51] Int. Cl.[6] ..... E21B 33/00

[52] U.S. Cl. ..... 166/373; 166/387; 166/85.3

[58] Field of Search ..... 166/187, 387, 166/373, 152, 154, 182, 191, 196, 85.1, 85.3, 85.5

[56] References Cited

U.S. PATENT DOCUMENTS

| | | | |
|---|---|---|---|
| 4,817,724 | 4/1989 | Funderburg, Jr. et al. | 166/337 |
| 4,869,324 | 9/1989 | Holder | 168/387 |
| 4,997,042 | 3/1991 | Jordan et al. . | |
| 5,024,273 | 6/1991 | Coone et al. | 166/289 |
| 5,044,444 | 9/1991 | Coronado | 166/387 |
| 5,186,258 | 2/1993 | Wood et al. | 166/387 |
| 5,191,939 | 3/1993 | Stokley . | |
| 5,584,343 | 12/1996 | Coone | 166/387 |
| 5,605,195 | 2/1997 | Eslinger et al. | 166/387 |

*Primary Examiner*—Frank Tsay
*Attorney, Agent, or Firm*—Browning Bushman

[57] ABSTRACT

A casing circulator 30, 54, 162 is provided for pumping fluid into a casing string to fill the casing string, and for temporarily sealing with an upper end of the casing string to circulate pressurized fluid through the casing string. The casing circulator includes a mandrel 130 axially movable with respect to a circulator body 84 from a retracted position to an extended position in response to fluid pressure acting on a piston 126. In the retracted position, the casing circulator is positioned with respect to the casing string for filling the casing string with fluid. When moved to its extended position, a sealing element 56, 158, 164 supported on the mandrel is in sealing engagement with the upper end of the casing string to circulate fluid through the casing string. According to the method of the invention, pressurized fluid is applied to the casing circulator to move the mandrel to the extended position, and may also be used to expand the sealing element into sealing engagement with the casing string.

20 Claims, 3 Drawing Sheets

EXTENDABLE CASING CIRCULATOR AND METHOD

FIELD OF THE INVENTION

The present invention relates to methods and apparatus for filling a casing positioned within a wellbore with a fluid, and for optionally sealing with the casing to circulate fluid through the casing. More particularly, this invention relates to an improved casing circulator and to equipment which automatically positions the circulator within the upper end of the casing during a casing fluid fill operation, and which significantly reduces or eliminates the tasks required by the stabber during a circulating fluid operation.

BACKGROUND OF THE INVENTION

When running casing into a hole, the drilling operator normally fills the casing with fluid as new joints are added to the casing string to prevent the collapse of the casing during the run-in operation. One of the rig hands, generally referred to as a stabber, is typically suspended at the position adjacent the rig elevator, and positions a hydraulic hose within the exposed upper end of the casing string to fill the casing with fluid. The stabber also aligns the top of the casing for threaded engagement into the lower joint of casing supported by the spider, stabs the lowering elevator over the top of the casing, and activates the elevator slips to grasp the casing. Maneuvering the hydraulic hose for periodically filling the casing increases the tasks of the stabber, and thus slows the time for running casing into a hole.

If the casing becomes stuck in the hole, the drilling operator frequently circulates drilling mud or another fluid down the casing to wash sand or other debris from the lowermost end of the casing, thereby freeing the stuck casing. To rig up for a conventional circulating operation, a circulating sub is threaded onto the upper threads of the last joint added to the casing string. The circulating sub seals with the casing, so that pressurized fluid can be pumped down the casing to free the stuck casing. The procedure for rigging up a circulating sub and for subsequently removing the circulating sub from the top of the casing frequently takes thirty minutes or more. Hours of valuable rig time may thus be used to attach and detach the circulating sub from the top of the casing string in order to perform several circulating operations when running a casing string into a well.

Equipment and techniques for more efficiently filling a casing and for circulating fluid through the casing are disclosed in U.S. Pat. No. 4,997,042. A casing circulator is positioned below the elevator, so that the top of the casing string encloses the circulator when the casing is grasped by the elevator. A bumper nose is provided on the lower end of the casing circulator to minimize damage when trying to stab the casing circulator into the top of the casing. Fluid may be pumped through the casing circulator to periodically fill the casing string while the top of the casing is positioned above the circulator and is grasped by the slips of the elevator. A packer element of the circulator may be inflated to seal with the casing for circulating operations.

An improved casing circulator is disclosed in U.S. Pat. No. 5,191,939. The circulator is centralized with respect to the elevator by a pair of guides which engage the bails supporting the elevator. Slots within a packer tube provide communication with the interior of the casing below the packer element. An adjustable stop is provided to limit upward movement of the casing circulator hanger by engagement with the traveling block hook when the casing circulator is set and the casing string is pressurized for a circulating operation.

Although the casing circulators discussed above significantly facilitate filling a casing string as casing is run into the well, drilling operators frequently still utilize a flexible hose to fill the casing. Drilling operators also incur the considerable expense of rigging up a circulating sub each time the casing becomes stuck in the well in order to circulate fluid through the casing string. One of the primary reasons why prior art casing circulators have not been more widely accepted relates to the time required for the stabber to position the circulator with respect to the upper end of the casing so that the circulator may be stabbed into the casing, and the elevator then stabbed over the casing. The casing may be rotated by the power tongs when attempting these stabbing operations, and the axis of the rotating casing may not be stationary. When the casing is twirling about a varying radius with respect to the vertical centerline of the rotary table, it is difficult and time consuming to stab the casing circulator into the top of the casing string. Accordingly, even an experienced stabber may require additional time to properly stab the casing circulator into the top of the casing, thereby slowing down the casing run-in operation. Moreover, the difficulty with the stabber easily maneuvering equipment above the rig floor must be considered in light of the elevated position of the stabber. The additional time required to safely stab the casing circulator into the casing thus may have a significant effect on the overall efficiency of the casing run-in operation.

If the casing circulator is not properly stabbed into the top of the casing when the drawworks are activated to lower the elevator, the circulator may become jammed against the top of the casing. In some situations, the jammed casing circulator may damage the casing threads so that a new joint of casing must replace the damaged casing. Also, if the actions of the stabber and the drawworks operator are not synchronized, the stabber may pinch his fingers between the casing circulator and the top of the casing, or between the casing circulator and the elevator. In some instances, the substantial weight of the elevator and associated equipment suspended from the traveling block when unintentionally supported on top of a casing string misaligned with respect to the casing circulator may bend the casing string.

Accordingly, those skilled in the art have long sought a more effective technique for safely and efficiently filling the casing string with fluid as the casing is run into a well, and for sealing the top of the casing so that fluid may be circulated through the casing to release a stuck casing string. The disadvantages of the prior art are overcome by the present invention, and improved methods and apparatus are hereinafter disclosed for safely and reliably filling casing with fluid as it is lowered into the wellbore, and for circulating fluid through the casing to release a stuck casing string.

SUMMARY OF THE INVENTION

An improved casing circulator and techniques for inputting fluids into the casing string as discussed herein may be utilized in either a conventional drilling rig, wherein the rotary table is provided at the rig floor, or in a top drive rig, wherein the casing is rotatable by a top drive unit suspended from the derrick. The casing circulator may be used in conjunction with a conventional slip-type elevator which is stabbed over the top of the casing, or with a side door elevator which opens about the upper end of a "laid out" casing, so that the elevator closes to engage the top coupling of the casing joint and raise the casing joint into a vertical position for threading into the top coupling of the casing string extending into the well. In either case, the elevator is then used to support the uppermost end of the casing string, with the elevator being suspended from a traveling block by a pair of bails.

The casing circulator is also supported from the traveling block, and when used in conjunction with a conventional elevator, may be spaced out by a selected length pup joint so that the lower end of the casing circulator normally resides within the interior of the elevator. When the elevator is stabbed over the top of the casing, the casing circulator is then inherently aligned with the top of the casing. When used in conjunction with a side door elevator, the circulator may be partially extended once the casing is positioned vertically by the elevator so that the lower end of the circulator is stroked into the interior of the casing. The operator on the rig floor controls activation of pumps to pass fluid through the casing circulator and into the casing. During normal casing run-in operations, fluid may thus be pumped through a packer tube of the casing circulator to fill the casing, and actions by the stabber normally are not required to perform this filling operation.

When it is desired to build up fluid pressure within the casing for a circulating operation, the operator on the rig floor may activate a suitable control for axially lowering the packer element with respect to the elevator to seal with the casing. According to one embodiment of the invention, a control flow line is provided between the casing circulator and a control panel or the rig floor. Pneumatic or hydraulic control pressure acts against a piston to force a casing mandrel axially downward against a coil spring, thereby lowering the packer element to an extended position within the casing. Once lowered to its fully extended position within the casing string, the control pressure may then inflate the packer element. Fluid pumps may then be activated for circulating fluid through the casing string. When the circulating pumps are stopped, control pressure is released from the casing circulator to deflate the packer element, and allow the coil spring to return the mandrel to its upward position, thereby raising the deflated packer element to its original position.

While a fluid actuatable element for sealing engagement with the casing string during the circulating operation is preferred, other types of sealing elements may be used. Axial movement of the mandrel in response to fluid pressure may thus press the seals of a mechanically set packer to seal against the interior of the casing string. Alternatively, axial movement of the mandrel may lower an elastomeric member into sealing engagement with an upper surface on the coupling of the casing for sealing with the casing in order to perform the circulating operation.

It is an object of the present invention to provide an improved casing circulator for safely and efficiently filling a casing string with a fluid and for sealing with the top of a casing string to circulate pressurized fluid through the casing string. A related object of the present invention is to provide a technique whereby a casing circulator will be automatically aligned with the top of the casing when the upper end of the vertical casing is supported within an elevator.

It is a further object of the present invention to improve the efficiency of running in a casing string by reducing the tasks required by a stabber in order to fill the casing string with fluid and to circulate pressurized fluid through the casing string.

Yet another object of this invention is that the casing circulator may be used with various drilling rig configurations, including rigs with a conventional rotary table, a top drive unit, a conventional slip-type elevator, or a side door elevator.

It is a significant feature of the present invention that the safety of the stabber is enhanced by avoiding the stabber having to manipulate the position of a casing circulator with respect to the top of a casing string.

Another related feature of the present invention is that the likelihood of damaging the top threads of a joint of casing or of bending a casing joint are substantially reduced or eliminated when using a conventional slip-type elevator by ensuring that the casing circulator is properly aligned with the casing string when the lower end casing circulator is stabbed into the top of the casing string. A related feature of the invention is that the casing circulator may be partially extended into the top of the casing string when supported by a side door elevator for filing the casing string, and may be fully extended for sealing engagement with the casing for a circulating operation.

It is a further feature of the present invention that pressurized fluid is preferably used to extend the casing circulator and thereby lower the sealing element of a casing circulator with respect to the casing string in order to form the circulating operation. After the circulating operation is complete, the applied fluid pressure may be released and the sealing element returned to its original retracted position.

A significant advantage of the present invention is that operations by a stabber generally are not required either to fill the casing string or to circulate fluid through a casing string. Accordingly, the time for casing run-in may be reduced.

A further advantage of the invention is that the release of fluid pressure to the casing circulator may first release the elastomeric element from sealing engagement with the casing, then retract the elastomeric element to its retracted position.

Another feature of the invention is that the sealing element of the casing circulator may inflate in response to fluid pressure for reliable sealing engagement with the casing string each time the casing circulator is set for a circulating operation. Alternatively, the sealing element may be mechanically set by axially moving a mandrel for sealing with either the interior of the casing string or the top of the casing string.

These and further objects, features, and advantages of the present invention will become apparent from the following detailed description, wherein reference is made to the figures in the accompanying drawings.

DETAILED DESCRIPTION OF THE PREFERRED EMBODIMENTS

Figure 1:
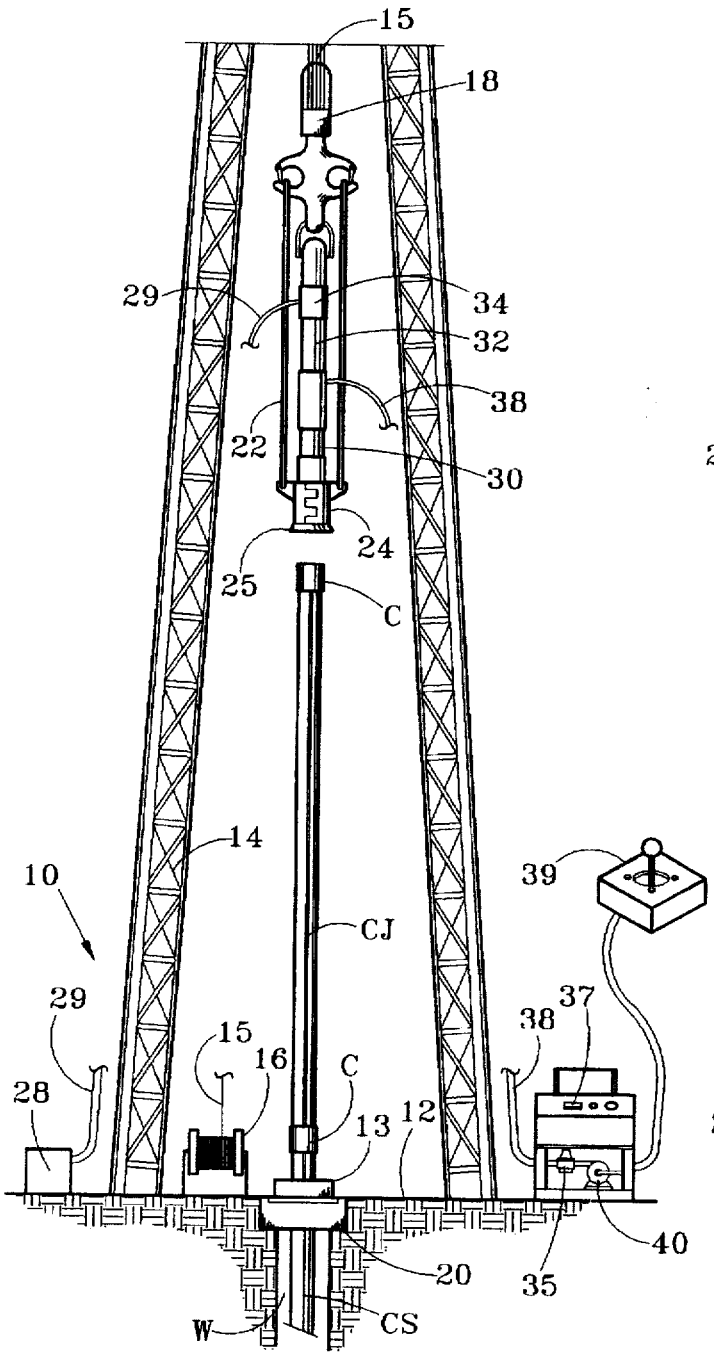
FIG. 1 is a simplified side view of a conventional drilling rig with a rotary table at the rig floor and the top of the casing positioned below both a slip-type elevator and a casing circulator with an inflatable sealing element in accordance with the present invention.

FIG. 1 depicts components of a conventional drilling rig 10 suitable for describing the operation of the casing circulator and the method of the present invention. The drilling rig 10 includes a conventional rig floor 12 and a suitable mast or derrick 14 extends above the rig floor for supporting a stationary crown block (now shown). A rotary table 20 is provided below the rig floor for rotating the casing string CS. A spider 13 is depicted for gripping the casing string CS to prevent its inadvertent dropping within the wellbore W. A pair of tongs (not shown) may be used for threadably connecting the lower threads on casing joint CJ with the upper coupling C of the casing string CS. Wire cables 15 conventionally extend from drawworks 16 adjacent the rig floor to the crown block and then to the traveling block 18, so that the traveling block may be easily moved up or down relative to the rig floor by actuation of the drawworks. A pair of bails or links 22 each suspended from side ears of the traveling block 18 support a slip-type elevator 24, which includes lower guide skirt 25 for assisting in stabbing the elevator 24 over the top of the casing joint CJ. The above apparatus is conventional and is well known to those skilled in the art, and accordingly will not be discussed in detail below.

The uppermost portion of the casing joint CJ may be gripped by slips 26 (see FIGS. 2 and 3) conventionally provided within the elevator 24. Once the casing joint CJ is threadably connected to the casing string CS, actuation of the drawworks 16 may be used to raise the elevator 24 to set the slips 26 on the casing joint CJ, thereby releasing the spider 13 from gripping engagement with the casing string CS. The drawworks 16 may then be actuated to lower the casing elevator 24 and thus the casing string CS into the wellbore W with the slips of the spider 13 remaining disengaged. Those skilled in the art appreciate that the casing will be continually gripped and supported either from slips 26 in the elevator 24 or from slips within the spider 13.

It should be understood that the term casing, as used herein, refers to any tubular oilfield product which may become stuck in a well and/or needs to be filled with fluid as it is lowered into the well. According to a preferred embodiment of the invention, drilling mud is used both as the filling fluid and as the circulating fluid. Drilling muds, completion fluids, or washing fluids are commonly used to both fill the casing string CS and assist in lowering a casing string during the run-in operation, and various liquids may be used for filling the casing string to prevent its collapse and for assisting in the run-in of the tubular into the well.

The casing circulator 30 is shown supported from a pup joint 32, which in turn is threadably connected to a support sub or cementing head 34 suspended from traveling block 18. Fluid from the mud pumps 28 adjacent the rig floor may be passed to the cement head 34 via flexible line 29, then passed through the cement head 34 and the pup joint 32 to the interior of the casing circulator 30. A gooseneck may be provided rotatable with respect to the cement head 34 so that the hose 29 does not impart a significant torque to the cement head during operation of the equipment. A conventional seal unit may also be provided between the gooseneck and the cement head to maintain fluid-tight communication between the flow channels while allowing the gooseneck to rotate with respect to the cement head.

A separate control line 38 may be used to pass control pressure from a pump 40 at the rig floor to the casing circulator 30 to extend the casing circulator, as described hereafter. The control pressure may be pneumatic, although hydraulic pressure from the rig floor to the casing circulator may be preferred for safety. A preferred system according to the invention is an air-over-hydraulic system. A control panel 37 is provided for use by an operator near the rig floor 12, with the control panel 37 optionally being interconnected with the mud pumps 28, the drawworks 16, and the pump 40 for providing gauge readings of flow from the pumps 28, 40, gauge readings of fluid pressure, drawworks payout of line 15, and similar readings conventional to an operator running in or pulling out a casing string in a well. One or more remote operator controls 39 may also be provided for controlling operation of these components. Accordingly, an operator at the rig floor may position himself for viewing the stroking of the casing circulator 30 as explained hereafter and, in response to conventional casing run-in activity and input from the stabber, may activate control 39 for supplying or terminating control pressure to the casing circulator 30 through line 38.

Figure 2:
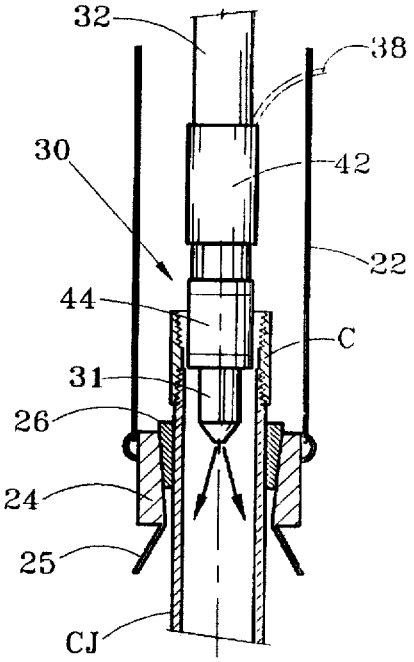
FIG. 2 is a simplified side view of the elevator as shown in FIG. 1 lowered over the top of a casing string, with the lower end of the casing circulator stabbed into the top of the casing string for filling the casing with fluid.

The casing circulator of the present invention may be used with various sizes of bails and traveling blocks. Those skilled in the art will recognize that the spacing between the bails is a function of a specific traveling block and elevator used, and that the size and cross-section of the bails will vary with different drilling operations. The length of the pup joint 32 may be selected so that the lower end of the casing circulator 30 secured thereto will automatically be normally positioned within the interior of the elevator 24, as shown in FIGS. 1 and 2, when the casing circulator is in its normal retracted position. Depending on the length of the bails 22, it may be desirable to provide guides or centering members (not shown) between the casing circulator 30 and the bails 22 to maintain the circulator centrally aligned with the elevator 24.

Referring to FIG. 2, the elevator 24 includes a lower guide skirt 25 which assists in aligning the upper end of the casing joint CJ with the elevator so that the elevator may be safely lowered or stabbed over the casing joint. When the casing joint CJ is within the elevator 24, the casing circulator 30 is positioned with its lower end within the interior of the elevator 24 and is automatically aligned with the casing joint. During normal casing run-in operations, the casing circulator 30 may be maintained in its deflated and retracted position, as shown in FIG. 2. As each joint of casing is added to the casing string CS, the casing circulator 30 is automatically stabbed into the top of a newly added casing joint, the elevator 24 activated by the stabber to grip the top of the casing string, and the mud pumps 28 briefly activated to fill the casing string with fluid.

Figure 4A:
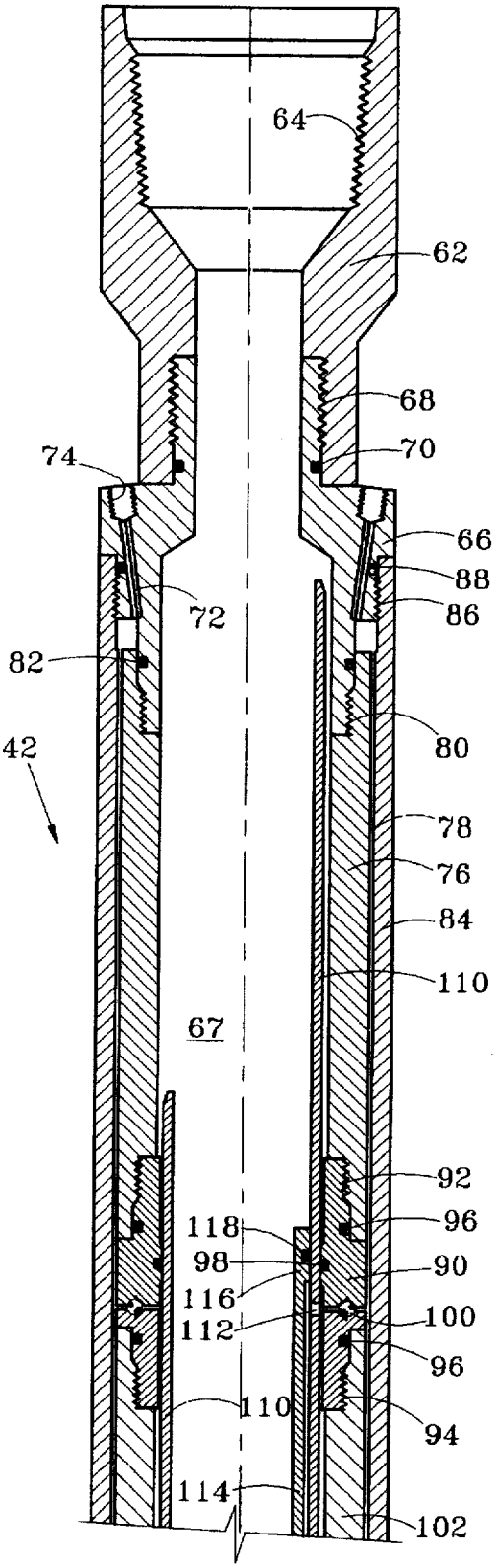
FIG. 4A is a detailed cross-sectional view of the top portion of an inflatable casing circulator according to the present invention, with the casing circulator on the right side of the centerline being shown in its retracted position for fluid filling the casing, and with the casing circulator components on the left side of the centerline being shown in its extended position for performing a circulating operation.
Figure 4B:
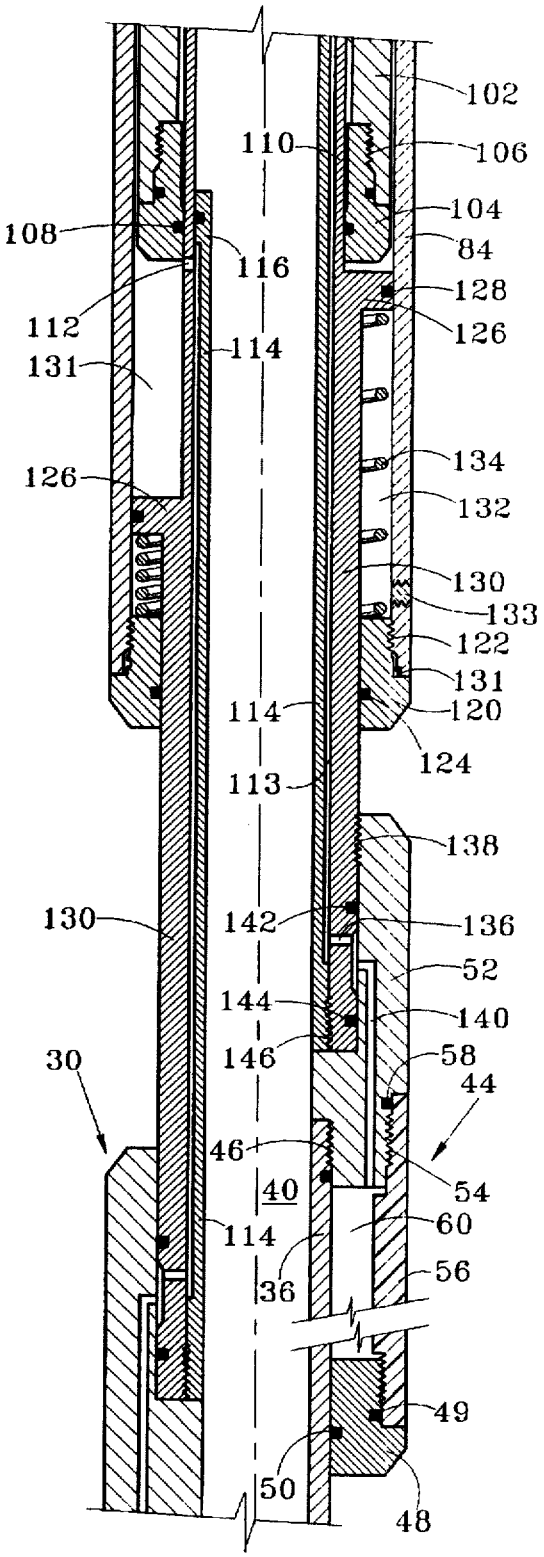
FIG. 4B is a detailed cross-sectional view of central and lower portions of the casing circulator as shown in FIG. 4A, with the components on the right side of the centerline shown in their retracted position and with the components on the left side of the centerline shown in their extended position.

Referring briefly to FIGS. 4A and 4B, the casing circulator 30 comprises an upper telescoping portion 42 and a lower inflatable seal portion 44. The seal portion 44 comprises a packer tube 36 having a central flow path 40 therein for passing fluid through the casing circulator. The packer tube 36 is threadably connected at 46 to the telescoping portion 42. An elastomeric packer inflation element 56 is spaced radially outward from the tube 36 and is secured at its upper end to a top packer sub 52 by threads 54. A fluid-tight connection between these components is provided by annular seal 58. An annular gap 60 thus exists between the exterior surface of the packer tube 36 and the inflation element 56, and this gap may subsequently be filled with a pressurized fluid to expand the packer inflation element 56 outward into sealed engagement with the casing joint CJ. External tubing line 38 as shown in FIG. 1 is in fluid communication with port 74 as shown in FIG. 4A, and is in sealed engagement with the flow path 140 in the top sub 52. Control fluid from the pump 40 may thus be transmitted through line 38 to inflate the sealing element 56.

Figure 3:
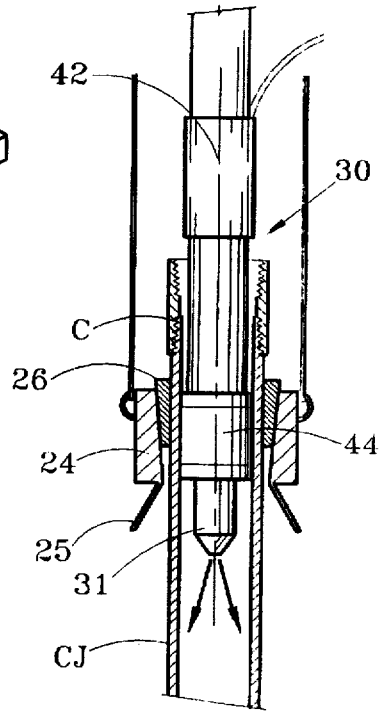
FIG. 3 is a simplified side view of the components as shown in FIG. 2, with the casing circulator being extended and the sealing element inflated to seal with the interior of the casing string.

A lower packer sub 48 is secured at the lower end of the inflation element 56. An annular seal 49 carried by the lower packer sub provides sealing engagement between the packer inflation element 56 and the lower packer sub 48. The lower packer sub 48 maintains sealed engagement with the packer tube 36 by seal 50. As the packer inflation element 56 is inflated, the lower sub moves axially closer to the upper sub 52 to accommodate radial outward expansion of the inflation element. Upward movement of the lower sub with respect to the packer tube may be limited by a stop surface (not shown). The inflatable seal portion 44 is only generally depicted in FIG. 4B, since it is functionally similar to the inflatable sealing portion disclosed in U.S. Pat. Nos. 4,997,042 and 5,191,939. Those skilled in the art will appreciate that the lower nose portion 31 of the casing circulator is generally depicted in FIGS. 2 and 3, and that fluid passed through the flow path 40 may be discharged from the casing circulator 30 as disclosed in U.S. Pat. No. 5,191,939.

The casing circulator of the present invention may thus be used to easily fill the casing string with drilling mud as the casing string is lowered into the wellbore. Picking up the elevator 24 will "set" or activate the elevator slips and will then release the spider slips at the rig floor. As the drawworks are activated and the casing string is lowered into the wellbore, the mud pumps 40 may be briefly activated to simultaneously fill the casing string, thereby minimizing the likelihood of collapse of the casing string while saving valuable rig time. Once the casing string CS is properly filled, the mud pumps may be shut off, the spider 13 set to grip the casing string, the elevator 24 released, and the process repeated with the next joint of casing.

Referring to FIGS. 4A and 4B, the coupling 62 of the casing circulator 30 may be interconnected by threads 64 with pup joint 32 as shown in FIG. 1. Top sub 66 is similarly threaded at 68 to the coupling 62, with O-ring 70 providing a sealed connection therebetween. A radially inner sleeve 76 is threaded at 80 to the top sub 66, while a radially outer sleeve or circulator body 84 is threaded at 86 to the top sub. O-rings 82 and 88 again provide for sealed connections between these components. One or more threaded ports 74 in the top sub 66 are each in fluid communication with the control flow line 38, and drilled passageways 72 fluidly interconnect ports 74 with the annular flow passageway 78 between the inner sleeve 76 and the housing 84. A check valve body 90 is threaded at 92 to the top inner sleeve 76, and at 94 to the bottom inner sleeve 102, with O-rings 96 providing sealed connections. The bottom inner sleeve 102 is connected by threads 106 to the sleeve sub 104, which is sealed to upper mandrel sleeve 110 by O-ring 108.

Upper mandrel sleeve 110 is continuously sealed with check valve body 90 by seal 98 carried on the check valve body, and mandrel 110 has a radial throughport or inflation port 112 therein. Piston 126, upper mandrel 110, and lower mandrel 130 are structurally interconnected and may be a monolithic component, as shown in FIGS. 4A and 4B. Piston 126 carries seal 128 which maintains sealing engagement with the inner surface of the housing 84. Lower housing sub 120 is connected at threads 122 to the housing 84, and mandrel seal 124 provides sealed engagement between the housing sub 120 and the lower mandrel 130. An annular chamber 132 radially between the lower mandrel 130 and the housing 84 provides a cavity for receiving a coiled spring 134. Spring 134 biases the piston 126 in its upward position, as shown on the right side of the centerline in FIGS. 4A and 4B. Lower mandrel 130 is threaded at 146 to an inner mandrel sleeve 114. The upper end 116 of inner mandrel sleeve 114 includes seal 118 for sealed engagement with the upper mandrel 110.

In an alternative embodiment, a seal 131 as shown in FIG. 4B is provided between the lower end of housing 84 and sub 120. The seals 124, 128 and 131 thus form a sealed chamber 132 below the piston 126 and between the mandrel 130 and the housing 84. This sealed chamber 132 may receive a compressible gas, such as nitrogen, which acts as an increasingly strong biasing force against downward movement of the piston 126. The lower end of housing 84 may thus contain a threaded port which may be opened for pressurizing the chamber 132 with nitrogen at a selected pressure, then plugged with plug 133. A sealed nitrogen chamber 132 may thus be used instead of spring 134 as the biasing member to bias the piston upward as shown in FIG. 4B. Also, a spring may be used in combination with a pressurized gas chamber, so that the size of the spring may be reduced.

The lower end of mandrel 130 is threaded at 138 to the sub 52, which may serve as the top sub for the inflatable sealing portion 44. O-ring 142 provides a fluid-tight connection between the mandrel 130 and the top sub 52. A flowpath 136 in the lower mandrel 130 provides communication between the annular passageway 113 between the inner mandrel sleeve 114 and the lower mandrel 130, so that fluid in the annular passageway 113 be transmitted through passageway 140 in the top sub 52 and then to the annular chamber 60 between the packer tube 36 and the inflatable sealing element 56.

Referring to FIG. 2, the absence of control pressure in port 74 as shown in FIG. 4A in combination with the biasing function of spring 134 will retain the components of the casing circulator in the retracted position, as shown on the right side of the centerline in FIGS. 4A and 4B. Mud pumps 28 may thus be activated to pass pressurized fluid through the cementing head 34 and the pup joint 32, and then through the flowpaths 67 in the reciprocating portion 42 of the casing circulator and the flowpath 40 in the sealing portion 44 of the casing circulator, so that the casing joint CJ may be filled with fluid to prevent its collapse.

In the event the casing string CS becomes stuck in the wellbore, the drilling operator may activate the pump 40 to first extend the casing circulator (lowering the inflation element 56, as explained hereafter) then inflate the element 56 to seal with the interior of the casing joint CJ. The operator may then activate the mud pumps to pass fluid through the casing circulator as shown in FIG. 3 to wash debris and lubricate the lowermost end of the casing string. While the washing operation is ongoing, the elevator may be lowered to lower the casing string in the hole while the casing circulator remains sealed with the upper end of the casing string. Once unstuck, the elevator 24 may be lowered to shortly above the rig floor, the slips of the spider 13 set to grip the casing string, and the elevator 24 then released from the casing string. The casing string may thereafter be lowered into the wellbore with the elevator 24 in a conventional manner. For many applications, it is desirable that the mud pumps 40 remain activated while lowering the casing string with the elevator to continue the washing operation and minimize the likelihood of the casing becoming re-stuck in the well.

An operator at the rig floor 12 may thus utilize control 39 to activate the air-over-hydraulic pump 40, thereby promptly transmitting hydraulic pressure to the port 74 in the casing circulator. The pressure increase is transmitted through the annular flowpath 78 between the radially inner mandrel 76 and the housing 84, and will act on the piston 126 to drive the piston downward, compressing the spring 134. As the piston 126 is compressed downward, pneumatic pressure is prevented from escaping through the check valve body 90 by the biased check 100. Downward movement of the piston 126 will stroke the sealing portion 44 of the casing circulator downward, thereby lowering the sealing element 56 to a position below the coupling C as shown in FIG. 3 and within the interior of the casing joint CJ. Once the port 112 in the upper mandrel 110 passes below the seal 108 (see FIG. 4B), pressurized fluid in the cavity 13 1 (which is in fluid communication with the annular flowpath 78) may be transmitted through the port 112 and into the annular flowpath 113 between the radially inner mandrel 114 and the lower mandrel 130, thereby allowing control pressure to flow through the port 136 and the passageway 140 then into the chamber 60 for inflating the elastomeric sealing element 56 to expand radially outward into sealing engagement with the interior surface of the casing joint CJ, as shown in FIG. 3. A pressure regulator 35 along the flow line 38 (see FIG. 1) may be set at a selected value to maintain the desired pressure level within the elastomeric sealing element 56 while the mud pumps 28 are activated to pump fluid through the casing circulator to conduct the pressurized washing operation to unstick the casing.

Once the washing operation is complete and the casing joint CJ has been unstuck from the well, the operator may use control 39 to deactivate the pump 40 thereby releasing control pressure to the casing circulator. Reduction in fluid pressure in the chamber 131 will first at least partially deflate the sealing element 56, and will then allow the spring 134 to force the piston 126 upward so that the port 112 passes upward past the seal 108. Once the pump 40 is deactivated and pressure is allowed to bleed from the line 38, the sealing element 56 may immediately deflate. Once the decreased pressure allows sufficient upward movement of the piston 126 so that port 112 passes upward past seal 108, the remaining fluid in the elastomeric sealing element will pass through the annular cavity 113 then past the biased check 100 into the annular cavity 78 while the spring 132 returns the casing circulator 30 to its fully retracted position. Since the elastomeric member 56 is at least partially deflated prior to axial return of the piston 126, the elastomeric member 56 may further deflate as the casing circulator is retracted.

In alternative embodiments, the casing circulator may include an inflatable sealing member as disclosed, although control pressure may be selectively passed to and released from the casing circulator by a 4-way ball valve operable with signals transmitted from the control panel 37 to the valve. Frequency or other wireless electronic signals may thus be conventionally transmitted the relatively short distance from the rig floor to the valve to control extension and retraction of the casing circulator. Also, those skilled in the art will appreciate that various configurations for the inflatable seal portion 44 may be used, as disclosed in the prior art directed to inflatable packers.

Figure 5:
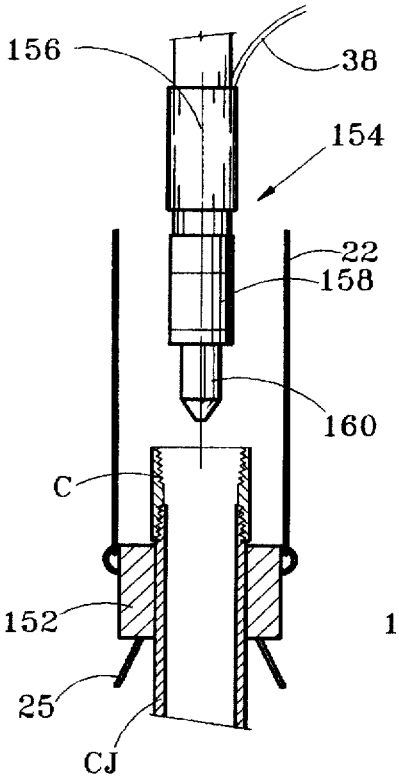
FIG. 5 is a simplified side view of a side door elevator and a casing circulator with a mechanically set sealing element positioned in its fully retracted position and located above both the side door elevator and the top coupling of the casing joint.
Figure 6:
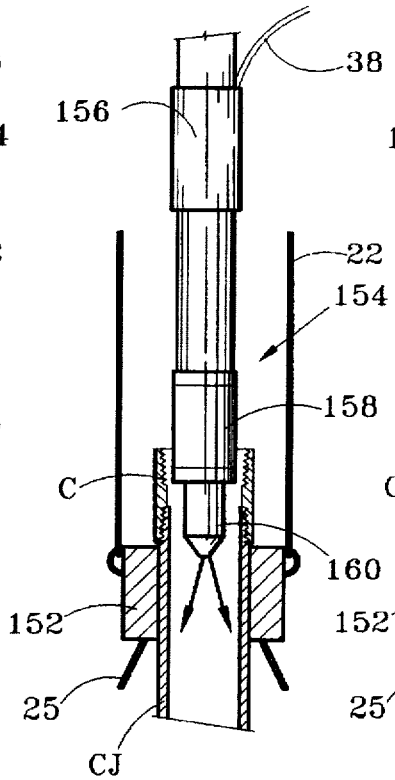
FIG. 6 is a simplified side view of the components shown in FIG. 5 with the casing circulator partially extended into the interior of the casing string for filling the casing string with fluid.
Figure 7:
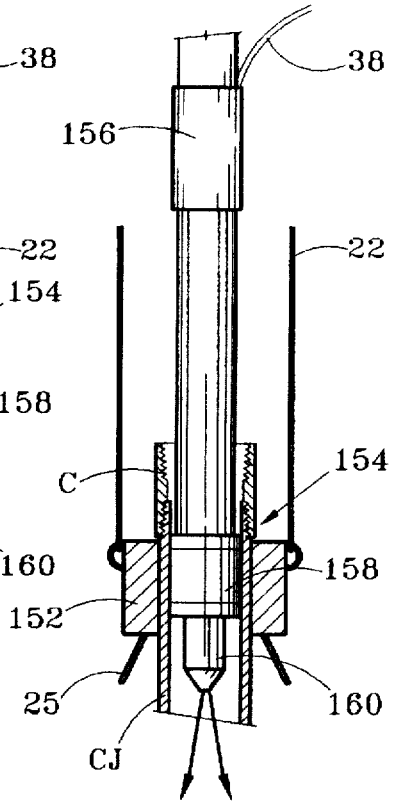
FIG. 7 is a simplified side view of the components shown in FIG. 5 with the casing circulator fully extended into the casing string and the sealing element expanded to seal with the interior of the casing string.

FIGS. 5, 6 and 7 depict an alternate casing circulator 154 which includes a mechanically compressible sealing portion 158 below the stroking or telescoping portion 156 of the casing circulator. For the embodiment as depicted in FIGS. 5, 6 and 7, the elevator 152 is a side door elevator rather than a slip-type elevator as discussed above. Accordingly, the top coupling C and the casing joint CJ rests on the body of the elevator 152 to support the casing joint on the elevator.

The casing circulator 154 is shown in FIG. 5 in its fully retracted position. The lower nose portion 160 of the casing circulator may be positioned above the top of the coupling C when the casing joint CJ is supported within the elevator 152. The position of the casing circulator 154 as shown in FIG. 5 allows the casing joint CJ to be moved laterally into position for being supported by a side door elevator without the casing circulator 154 being engaged by the casing joint CJ. Once the lower end of the casing joint CJ has been threaded into the casing string, the pump 40 may be activated by the operator to stroke the telescoping portion 156 to an intermediate position, as shown in FIG. 6. In the intermediate position as shown in FIG. 6, at least the nose 160 of the circulator below the sealing member 158 is positioned within the casing joint CJ, so that mud may then be transmitted through the casing circulator to fill the casing string with fluid, as previously described. In a preferred embodiment of the invention, the sealing element 158 will move to the intermediate position as shown in FIG. 6 when the regulator 35 as shown in FIG. 1 maintains a selected pressure, e.g., 300 psi, within the flow line 38 sufficient to partially compress a spring functionally similar to the spring 134 as shown in FIG. 4B. Accordingly, the casing circulator may be stroked to this intermediate position, then the mud pump activated to fill the casing string with fluid. Once the mud pumps are deactivated, the 300 psi control pressure in line 38 may be released from the casing circulator, so that the spring or other biasing member returns the casing circulator to its fully retracted position, as shown in FIG. 5.

If the casing becomes stuck in the wellbore, the operator may regulate control 39 to supply a higher control pressure in line 38, e.g., 800 psi, thereby applying more pressure to the piston within the casing circulator 154 and stroking the piston downward to its fully extended position, as shown in FIG. 7. This extension may be initiated with the casing circulator 154 being either in its fully activated position, as shown in FIG. 5, or in its intermediate position as shown in FIG. 6. Once moved to the fully extended position, the sealing element of the casing circulator 154 is mechanically compressed to expand radially outward into sealing engagement with the casing string, as shown in FIG. 7. For this embodiment, the sealing portion 158 of the casing circulator 154 is thus functionally equivalent to a mechanically set packer which is sealed and released from sealing engagement with the interior of a casing joint by stroking of a mandrel. In this case, the axially movable mandrel for the mechanically set packer is stroked in response to the presence or absence of fluid pressure supplied to the casing circulator through the line 38. Those skilled in the art will appreciate that the telescoping portion 156 of the casing circulator is only generally depicted in FIGS. 5–7, and that the telescoping portion of the actual casing circulator needs to be much longer than that depicted in the figures to allow for axial stroking from the fully retracted position to the fully extended position.

Figure 8:
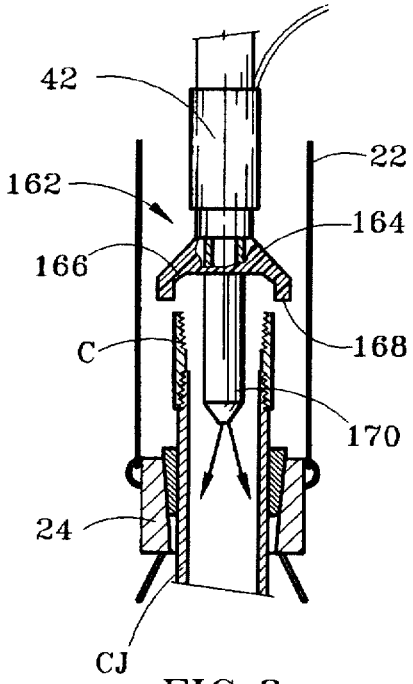
FIG. 8 is a simplified side view of a slip-type elevator and an alternate embodiment of a casing circulator with the lower end of the casing circulator stabbed into the top of the casing string for filling the casing with fluid.
Figure 9:
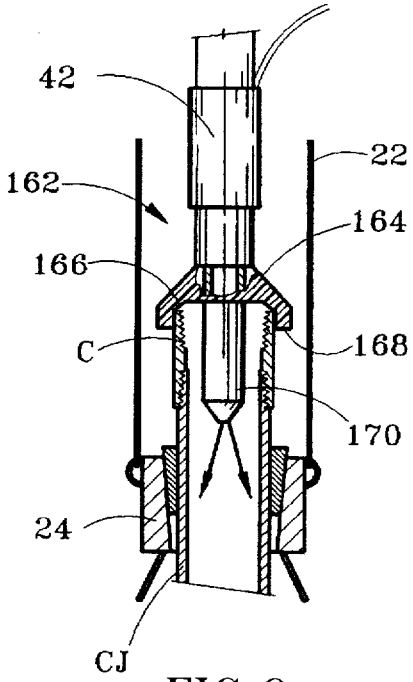
FIG. 9 is a simplified side view of a slip-type elevator with the alternate embodiment casing circulator being extended and the sealing element in sealing engagement with the top of the casing string for circulating fluid through the casing.

FIGS. 8 and 9 depict still a further embodiment of a casing circulator 162 according to the present invention, wherein the casing joint CJ is supported within a slip-type elevator, as shown in FIGS. 2 and 3. For the casing circulator 162, however, the inflatable sealing element has been replaced with an inverted cup-shaped sealing member 164 which includes a lower surface 166 and a ring portion 168 extending below the surface 166. An inner surface of the ring portion 168 is adapted for sealing engagement with an outer surface of the coupling C. In theory, the lower surface 166 may also provide sealing engagement with the top of the coupling C, although in practice it may be difficult to maintain a seal with the top of the coupling, and a seal with the outer cylindrical surface of the coupling C or with the top of the casing joint CJ is preferred. In the position as shown in FIG. 8, the casing circulator 162 is retracted so that the nose portion 170 is within the interior of the casing joint CJ for filling the casing string with fluid once the elevator 24 is stabbed over the top of the casing joint. If the casing becomes stuck in the well, control pressure in the line 38 may stroke the casing circulator 162 to drive the sealing member 164 downward, thereby sealing the casing circulator with the top of the casing joint as shown in FIG. 9.

Based on the foregoing disclosure, various other embodiments should now be apparent to one skilled in the art. For example, either an inflatable sealing member as shown in FIGS. 2 and 3 or a cup-shaped sealing member as shown in FIGS. 8 and 9 may be used with a casing circulator intended for sealing with a casing joint positioned within a side door elevator. For either the inflatable or cup-shaped casing circulator/side door elevator embodiment, a reciprocating or stroking portion having an intermediate position would preferably be utilized. For these embodiments, an intermediate position of the casing circulator would position the nose portion of the casing circulator as shown in FIGS. 2 and 8, respectively.

The casing circulator of the present invention may also be reliably used to pressure test casing. The casing circulator as discussed herein is thus able to reliably seal the top of the casing string and thereby either establish the necessary sealed cavity within the casing string to conduct a pressure test or pump pressurized fluid through the casing string for a washing or similar operation.

Various types of alignment members may be used to properly position the casing circulator with respect to the bails and thus the elevator. Various techniques may be used in the inflatable casing circulator for releasably connecting the packer tube and the sealing element, for allowing the fluid pressure to set the sealing element, and for thereafter allowing fluid flow through the set or unset casing circulator and into the casing. The casing circulator may employ a mechanically set packer for sealing with the interior of the casing joint, or may employ any type of seal for static sealing engagement with the top, the outer diameter, or the inner diameter of the casing joint. Various techniques may also be used for limiting upward movement of the set circulator within the casing string. Accordingly, the invention is limited not by the specific structures and embodiments described herein.

What is claimed is:

1. A casing circulator for pumping fluid into a casing string extending from an elevator on a rig into a wellbore and for temporarily sealing with the upper end of the casing string to circulate pressurized fluid through the casing string, the casing circulator comprising:

a circulator body having a throughbore therein about a central axis for pumping fluid into the casing string;

a mandrel having a fluid flowpath therein in fluid communication with the bore of the circulator body, the mandrel being axially movable with respect to the circulator body from a retracted position to an extended position;

a fluid-responsive piston carried by the mandrel for axially moving the mandrel from the retracted position to the extended position in response to control fluid;

a biasing member for biasing the mandrel toward its retracted position; and a sealing element supported on the mandrel for sealing engagement with the upper end of the casing string when control fluid moves the mandrel to the extended position.

2. The casing circulator as defined in claim 1, wherein the sealing element is an inflatable elastomeric sealing member for sealing engagement with an inner cylindrical surface of the casing string.

3. The casing circulator as defined in claim 2, further comprising:

a flow line for passing control fluid to the casing circulator to moving the piston; and a check valve for releasing control fluid from the inflated elastomeric sealing member.

4. The casing circulator as defined in claim 2, wherein the mandrel comprises:

a radially outer sleeve for supporting the inflatable elastomeric member and the piston; and a radially inner sleeve having an upper end for sealed engagement with the radially outer sleeve, a lower end secured to the radially outer sleeve, and a passageway between the radially outer sleeve and the radially inner sleeve for transmitting control fluid to the inflatable elastomeric member.

5. The casing circulator as defined in claim 2, further comprising:

a mandrel seal for dynamic sealing between the circulator body and the axially extendable mandrel; and an inflation port within the mandrel for moving axially past the mandrel seal for transmitting control fluid to the inflatable elastomeric sealing member.

6. The casing circulator as defined in claim 1, further comprising:

a piston seal carried by the piston for sealing with the circulator body to form a control fluid chamber above the piston and a biasing member chamber below the piston for housing the biasing member.

7. The casing circulator as defined in claim 6, wherein the biasing member includes at least one of a coiled spring and a pressurized gas chamber acting against the piston to bias the piston toward its retracted position.

8. The casing circulator as defined in claim 1, wherein the circulator body includes upper threads for threaded engagement with a pup joint having a selected axial length for positioning a lower end of the casing circulator within the casing string when the mandrel is in its retracted position.

9. The casing circulator as defined in claim 1, wherein the sealing element is axially compressible in response to axial movement of the mandrel from the retracted position to the extended position for compressing the sealing element into sealing engagement with an inner cylindrical surface of the casing string.

10. The casing circulator as defined in claim 1, wherein the sealing element is an elastomeric member for sealing with an outer surface of the casing string.

11. A casing circulator for pumping fluid into a casing string extending from an elevator on a rig into a wellbore and for temporarily sealing with the upper end of the casing string to circulate fluid through the casing string, the casing circulator comprising:

a circulator body having a throughbore therein about a central axis for pumping fluid into the casing string;

a mandrel having a fluid flowpath therein in fluid communication with the bore of the circulator body, the mandrel being axially movable with respect to the circulator body from a retracted position to an extended position;

a fluid-responsive piston carried by the mandrel for axially moving the mandrel from the retracted position to the extended position in response to control fluid;

a biasing spring for biasing the mandrel toward its retracted position;

an inflatable elastomeric sealing element supported on the mandrel for sealing engagement with the upper end of the casing string when control fluid moves the mandrel to the extended position; and a flow line external of the circulator body for passing control fluid to the casing circulator to move the mandrel to the extended position and to inflate the elastomeric sealing element.

12. The casing circulator as defined in claim 11, further comprising:

a check valve for releasing control fluid from the inflated elastomeric sealing member;

a mandrel seal for dynamic sealing between the circulator body and the axially extendable mandrel; and an inflation port within the mandrel for moving axially past the mandrel seal for transmitting control fluid to the inflatable elastomeric sealing member.

13. The method of pumping fluid into a casing string extending from an elevator on a rig into a wellbore and temporarily sealing with an upper end of the casing string to circulate fluid through the casing string, the method comprising:

positioning the upper end of a casing string within the elevator;

positioning a casing circulator having a throughbore therein in a retracted position such that the lower end of the casing circulator is within the upper end of the casing string;

biasing the casing circulator to the retracted position;

providing a sealing element on a mandrel axially movable with respect to a casing circulator body from the retracted position to an extended position;

periodically pumping fluid through the casing circulator when in the retracted fill position to fill the casing string with fluid;

applying pressurized fluid to the casing circulator for axially moving the mandrel to the extended position for sealing engagement between the casing circulator and the upper end of the casing string; and pumping fluid through the casing string when the casing circulator is in the extended position.

14. The method as defined in claim 13, further comprising:

inflating the sealing element with control fluid for sealing engagement with an inner cylindrical surface of the casing string.

15. The method as defined in claim 14, further comprising:

providing a check valve for automatically releasing control fluid from the inflated sealing element while the mandrel is returning from the extended position to the retracted position.

16. The method as defined in claim 14, further comprising:

releasing control fluid to at least partially deflate the elastomeric sealing member prior to returning the mandrel to its retracted position.

17. The method as defined in claim 13, wherein the sealing element is compressed by the axially movable mandrel for sealing engagement with an inner cylindrical surface of the casing string.

18. The method as defined in claim 13, wherein the sealing element is adapted for sealing with an outer surface of the casing string.

19. The method as defined in claim 13, wherein the casing circulator is suspended from a pup joint having a selected axial length such that a lower end of the casing circulator is positioned within the elevator prior to positioning the upper end of the casing string within the elevator.

20. The method as defined in claim 13, further comprising:

positioning the elevator about the upper end of a casing joint;

raising the elevator and the casing joint supported thereon to an upper position;

threadably connecting the raised casing joint to a casing string;

applying control pressure to lower the mandrel and the sealing element axially with respect to the elevator from a raised position to the retracted position such that the lower end of the casing circulator is within the upper end of the casing joint when in the retracted position.

* * * * *